US006431311B1

(12) United States Patent
Brown et al.

(10) Patent No.: US 6,431,311 B1
(45) Date of Patent: Aug. 13, 2002

(54) MUFFLER WITH INTERCHANGEABLE OUTLET TIPS

(75) Inventors: Daniel Joseph Brown, Annandale, NJ (US); Gregory Ward Nilsson, Ann Arbor, MI (US)

(73) Assignee: Scambia Industrial Developments AG, Schaan (LI)

( * ) Notice: Subject to any disclaimer, the term of this patent is extended or adjusted under 35 U.S.C. 154(b) by 0 days.

(21) Appl. No.: 09/598,524

(22) Filed: Jun. 21, 2000

(51) Int. Cl.[7] ..... F01N 7/18

(52) U.S. Cl. ..... 181/282; 181/227; 181/228; 181/238; 181/239

(58) Field of Search ..... 181/243, 241, 181/227, 228, 238, 239

(56) References Cited

U.S. PATENT DOCUMENTS 2,025,271 A * 12/1935 Compo ..... 285/189
2,732,026 A * 1/1956 Folts ..... 181/243
3,200,902 A * 8/1965 Jones ..... 181/243
4,475,623 A * 10/1984 Gerber et al. ..... 181/243
4,537,278 A * 8/1985 Okada et al. ..... 181/227
4,756,383 A * 7/1988 Sterrett ..... 181/243

FOREIGN PATENT DOCUMENTS

JP 404036007 * 2/1992

* cited by examiner

*Primary Examiner*—Shih-Yung Hsieh
(74) *Attorney, Agent, or Firm*—Sidley Austin Brown & Wood, LLP

(57) ABSTRACT

A muffler assembly is disclosed allowing one or more outlet tips to be secured to an exhaust. The muffler comprises a casing having an outlet end including threaded holes or threaded bolts attached to the casing, an outlet tip with a tubular member and an annular flange connected to the tubular member, wherein the flange has a plurality of holes or incisions and wherein screws or nuts cooperate with the threaded holes or threaded bolts, respectively, to secure the outlet tip to the casing.

13 Claims, 4 Drawing Sheets

MUFFLER WITH INTERCHANGEABLE OUTLET TIPS

BACKGROUND OF THE INVENTION

The present invention is directed to mufflers having replaceable exhaust outlet tips.

It is common for vehicle owners to change their exhaust system several times a year to achieve an alternative look to their vehicle. Often, in an exhaust system the outlet tip is welded to the (last) muffler of the exhaust system. The other parts of the exhaust system, such as the exhaust manifold, catalytic converter, flexible connecting member(s), first muffler, last muffler and intermediate pipes are often also interconnected by welded pipes so that the complete exhaust forms an inseparable unit. Such a unit has the disadvantage that the complete (last) muffler or even additional exhaust parts must be replaced when changing the outlet tip. Further, since each muffler requires a significant retooling of the assembly line, a long lead time is required when ordering a particular muffler.

As is known in the art, however, the tip may be connected to a muffler by a detachable pipe clamping mechanism as disclosed in U.S. Pat. No. 6,006,859. In particular, such tips are fitted over an existing tailpipe of the muffler. Such a construction, however, adds extra weight and extreme tension, which may result in a break in the tailpipe necessitating the replacement of the whole muffler.

It is therefore an object of the present invention to provide muffler assemblies which overcome the problems and disadvantages, associated with the prior art mufflers.

It is a further object of the present invention to provide a muffler having a variety of detachable exhaust outlet tips to allow a customer of an exhaust (or at least muffler) to interchange tips easily and thus, have various options for his or her vehicle.

SUMMARY OF THE INVENTION

In accordance with the invention, there is provided an exhaust including a muffler comprising a casing with an inlet end, outlet end and an outlet tip. The outlet end has an end wall and a number of nuts or bolts welded to the end wall. The nuts or bolts are separately and equally distributed around the end wall to form threaded holes or threaded bolts, respectively. The outlet tip is provided with a tubular member and an annular flange having holes or incisions, wherein the flange is fastenable to the end wall of the muffler casing by screws (i.e, cap screws), preferably, button-head screws. In an alternate embodiment, the welded nuts or bolts could be replaced by threaded bores in a thicker annular end wall portion so that the flange of the tip could be fastened to the end wall by removable nuts. In a further embodiment, the outlet end has two outlet ports and two groups of threaded holes or threaded bolts connected to the casing, wherein each group is distributed around one of the outlet ports and wherein two tips are detachably fastened to the casing, each of the tips correspond to one of the outlet ports.

The muffler according to the invention permits the alternate fastening of a great variety of outlet tips to the same muffler casing. Such tips may have different diameters and designs. Also, two interchangeable tips may be fastened to one casing. Moreover, since the tips are attached to the muffler and not on top of the muffler, such an assembly overcomes the muffler replacement problems found in the pipe clamping mechanisms of the prior art.

BRIEF DESCRIPTION OF THE DRAWINGS

The features and objects of the present invention and the advantages thereof will become more apparent and the invention itself will be more fully understood from the following detailed description of the preferred embodiments when read with reference to the accompanying drawings, wherein.

DETAILED DESCRIPTION OF THE INVENTION

Figure 1:
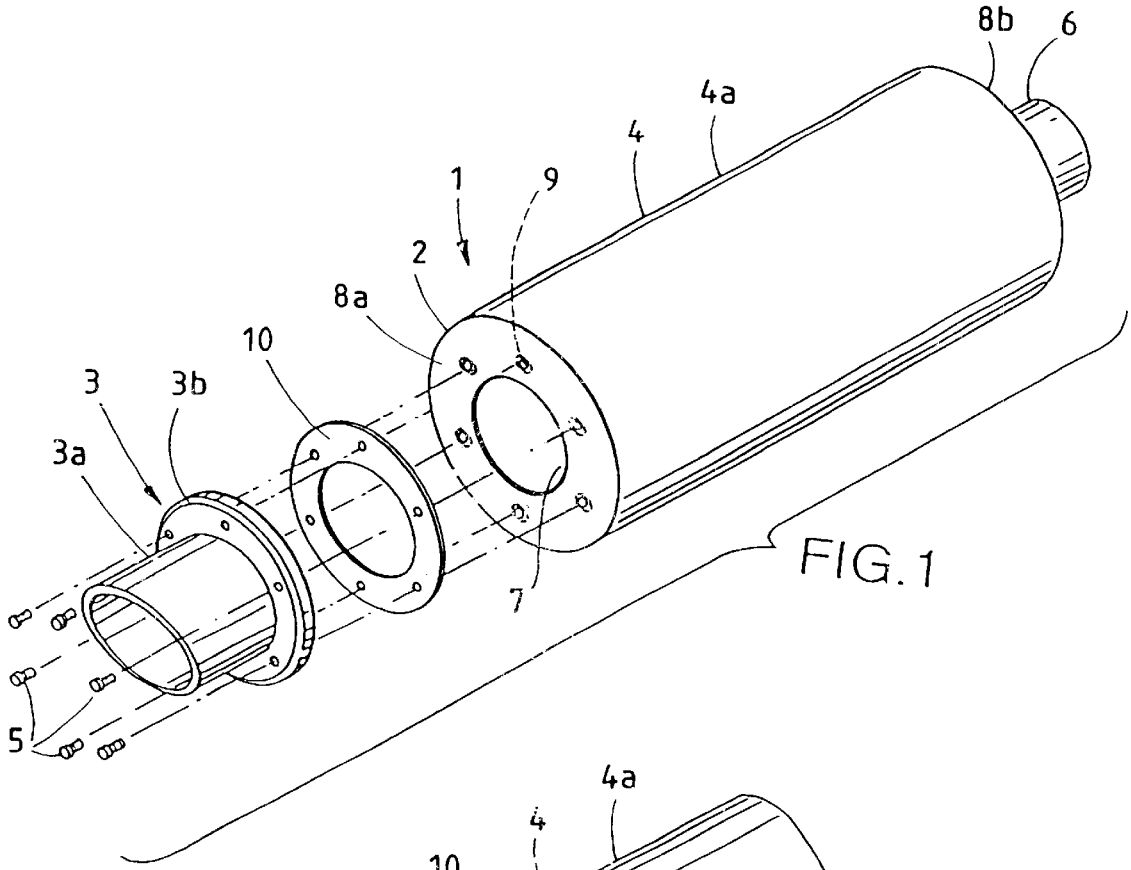
FIG. 1 is an exploded view of a first embodiment of a muffler according to the invention.

FIG. 1 illustrates a muffler 1, according to the present invention, having a hollow casing 4 including a tubular wall 4*a* and end walls 8*a* and 8*b* limiting an internal space 7, wherein tubular wall 4*a* is connected to end walls 8*a* and 8*b* and wherein end wall 8*a* includes an outlet port. Preferably, tubular wall 4*a* is substantially cylindrical and circular in cross-section and end walls 8*a* and 8*b* are substantially flat. Additionally, tubular wall 4*a* and end walls 8*a* and 8*b* consist of thin sheet metal pieces and are firmly and substantially undetachably connected to each other by welding, flanging or the like. Internal space 7 may be empty or comprise at least one section containing sound-absorbing and heat insulating material consisting, for example, of mineral fibers, such as basalt wool, rock wool, glass wool and/or the like and/or comprise at least one internal pipe and/or partition or the like.

The casing 4 further includes an inlet end 6 undetachably connected to end wall 8*b* for connecting the muffler 1 to a pipe, another muffler, a catalytic converter and/or exhaust manifold of an exhaust and an outlet end 2 for attachment of an outlet tip 3. The outlet end 2 comprises end wall 8*a* and nuts 9 welded to the inner surface of the end wall 8*a* for forming threaded holes.

Figure 2:
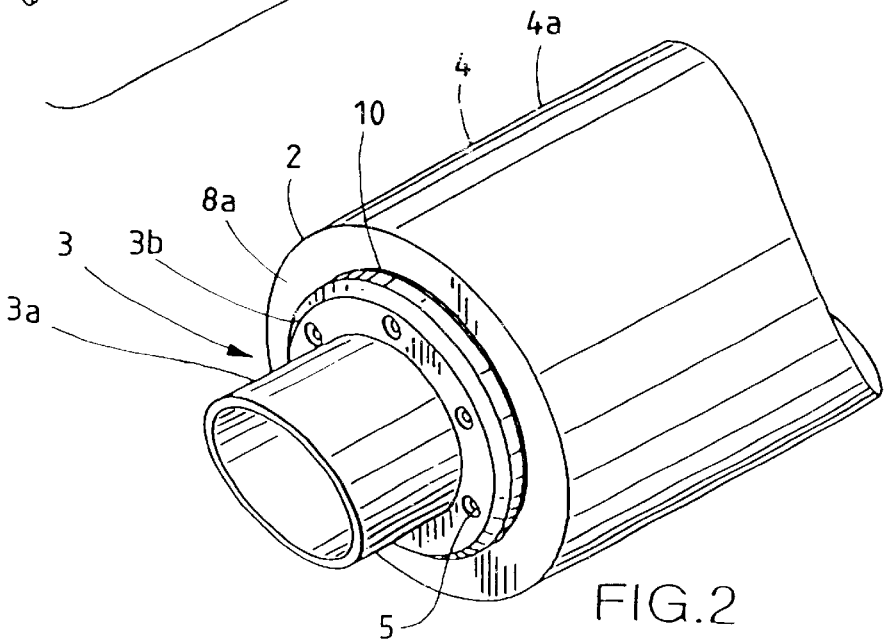
FIG. 2 is a perspective view of an end portion of the muffler of FIG. 1 at an increased scale.
Figure 3:
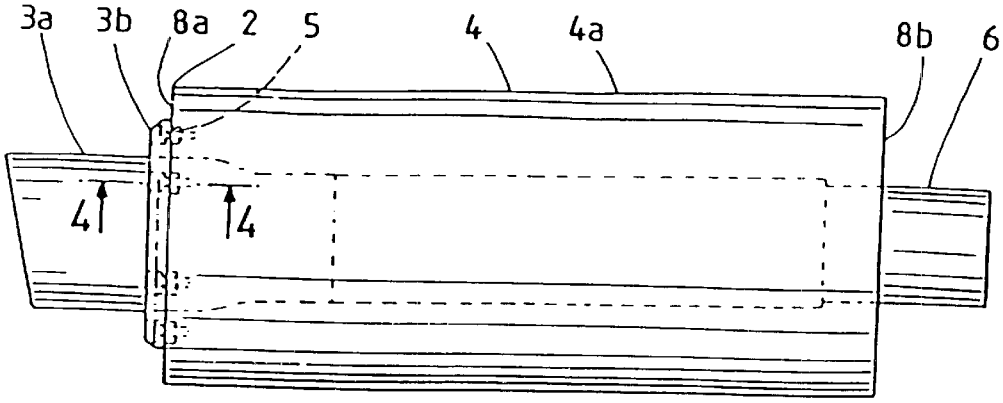
FIG. 3 is a side view of the muffler of FIG. 1.
Figure 4:
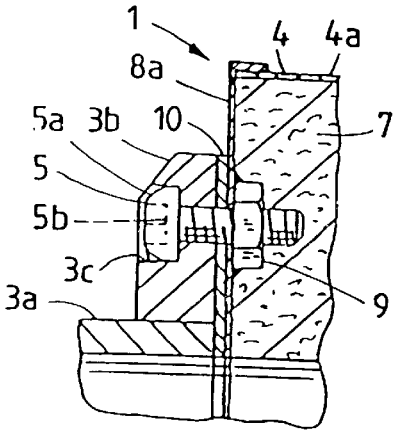
FIG. 4 is a cross sectional view of the muffler of FIG. 1 along line 4—4.

The outlet tip 3 has a tubular member 3*a* and an annular flange 3*b* undetachably connected to the tubular member 3*a*. The tubular member 3*a* is straight and parallel to the axis of the casing, namely coaxial therewith, and has, at the free end, an edge lying in a plane which forms an angle with the axis of the tubular member, wherein this angle is, for example, different from 90° but could also be 90°. The annular flange 3*b* is removably attached to outlet end 2. Preferably, a gasket 10 having holes is provided between the end wall 8*a* and the annular flange 3*b* to seal the interior space 7 of the casing 4. As illustrated in FIG. 4, the annular flange 3*b* has holes, such that the holes have a first, narrower portion and a second, wider portion, 3*c*, wherein both these portions are cylindrical. As illustrated in FIGS. 2, 3 and 4, screws 5, preferably, button-head screws are removably screwed into the nuts 9 of the outlet end 2, extending through holes of the gasket 10 and a section of the screws 5, namely at least a part of the screw heads 5*a*, is received in the wider portion 3*c* of the holes of the flange 3*b* such that the tips 3 are detachably attached to the muffler. The threaded holes of the nuts 9 of the casing 4 and the holes of the flange 3*b* are equally distributed on a circle or circular surface around an outlet port of end wall 8*a* and a circular surface of the flange 3*b,* respectively coaxial to the tubular member 3*a* of tip 3. Each screw head 5*a* has a multiple cornered hole 5*b.*

Figure 5:
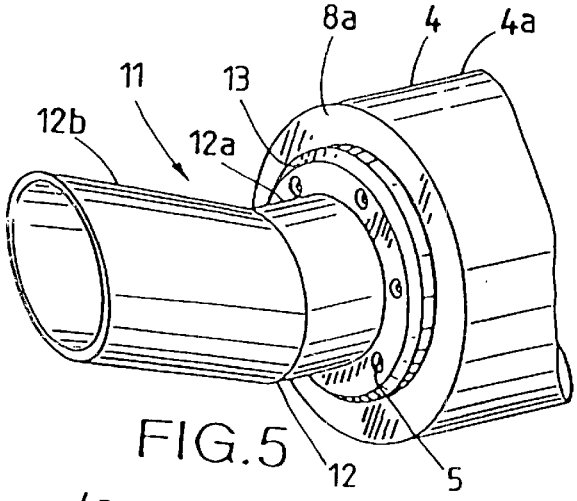
FIG. 5 is a perspective view of an end portion of the muffler of FIG. 1 with a first alternate tip attached thereto.

FIG. 5 shows an alternate outlet tip 11 replacing outlet tip 3 of FIG. 1. It is understood that the remaining elements are similar to those of FIG. 1. The alternate outlet tip 11 has a tubular member 12 and an annular flange 13, wherein the annular flange 13 is undetachably connected to the tubular member 13. The tubular member 12 comprises two cylindrical portions 12*a* and 12*b,* respectively, of varying lengths, wherein portion 12*a* is coaxial to casing 4 and portion 12*b* is undetachably connected at an angle to portion 12*a.*

Figure 6:
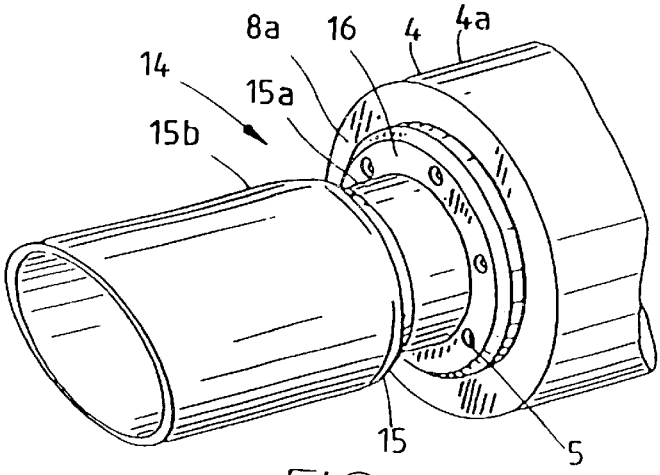
FIG. 6 is a perspective end view of an end portion of the muffler of FIG. 1 with a second alternate tip attached thereto.

FIG. 6 shows a second alternate outlet tip 14 replacing outlet tip 3 of FIG. 1. It is understood that the remaining elements are similar to those of FIG. 1. The second alternative outlet tip 14 has a tubular member 15 and an annular flange 16, wherein the annular flange 16 is undetachably connected to the tubular member 15. The tubular member 15 comprises two cylindrical portions 15*a* and 15*b,* respectively, of varied lengths and widths undetachably connected to each other and coaxial with casing 4.

Figure 7:
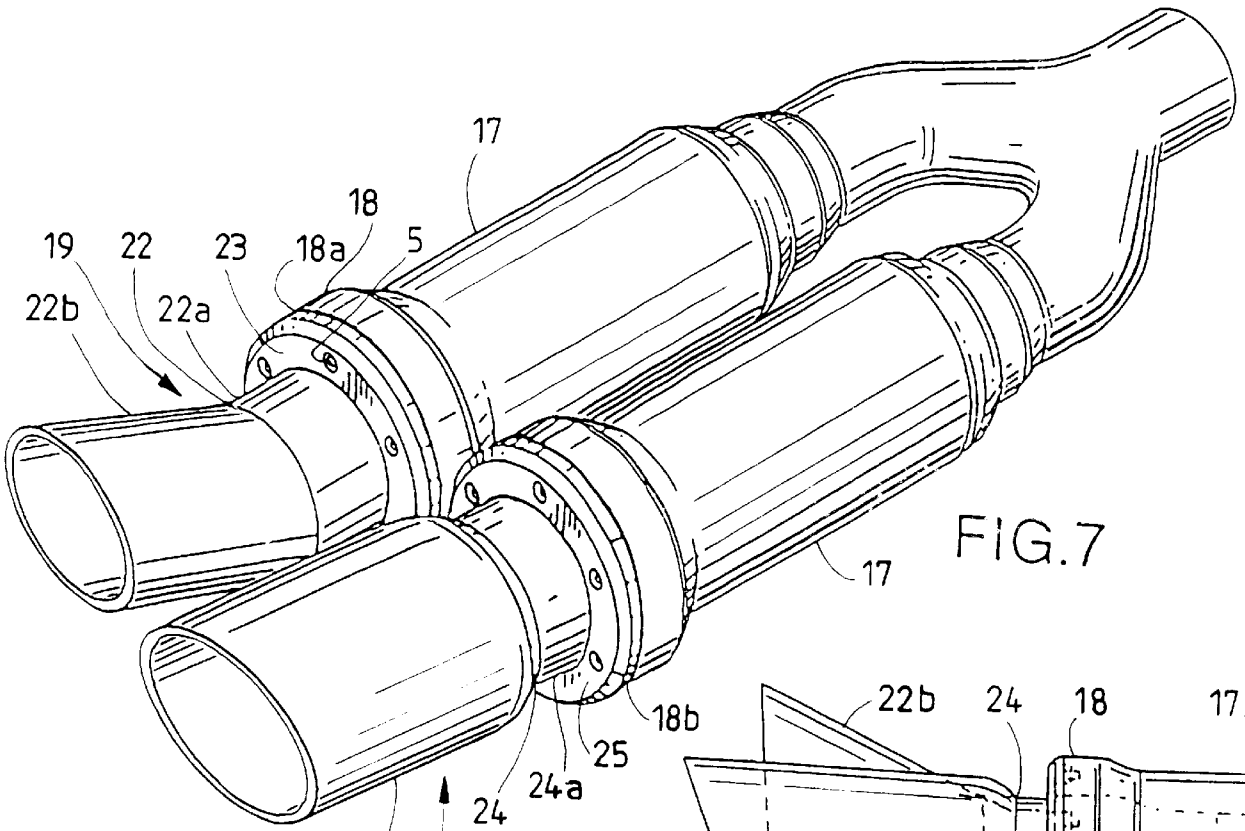
FIG. 7 is a plan view of a second embodiment of a muffler according to the invention.
Figure 8:
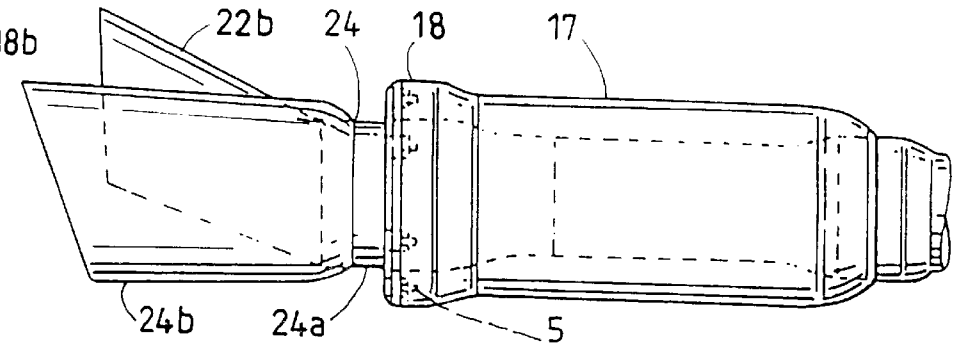
FIG. 8 is a side view of the embodiment of FIG. 7.

FIG. 7 illustrates an alternate embodiment of the invention in which two tips 19 and 20, respectively are each detachably connected to a two-casing muffler. In this embodiment, the casing 17 has an outlet end 18 having two ports 18*a* and 18*b* and two groups of threaded holes or bolts, wherein each group is distributed around one of the ports 18*a* and 18*b,* respectively. Each of the tips 19 and 20 is detachably fastened to the casing 17, in the manner described with reference to FIGS. 1–4. In particular, tip 19 has a tubular member 22 and annular flange 23 and tip 20 has a tubular member 24 and an annular flange 25, wherein flanges 23 and 25 each have holes with a first, narrow portion and a second, wider portion, wherein both portions are cylindrical. As illustrated in FIGS. 7 and 8, screws 5 are removably screwed into the holes of ports 18*a* and 18*b,* respectively, of the outlet end 18 and a section of the screws 5 is received in the wider portion of each of the flanges 23 and 25 such that the outlet tips 19 and 20 can each be alternately fastened to the casing 17.

The tubular member 22 and the tubular member 24 are of different shapes and different dimensions, as illustrated in FIG. 7. In particular, the tubular member 22 comprises two cylindrical portions 22*a* and 22*b* of varying lengths, wherein the portion 22*a* is coaxial to the casing 17 and the portion 22*b* is undetachably connected at an angle to the portion 22*a.* The tubular member 24 comprises two cylindrical portions 24*a* and 24*b,* respectively, of varied lengths and widths undetachably connected to each other and coaxial with the casing 17.

Figure 9:
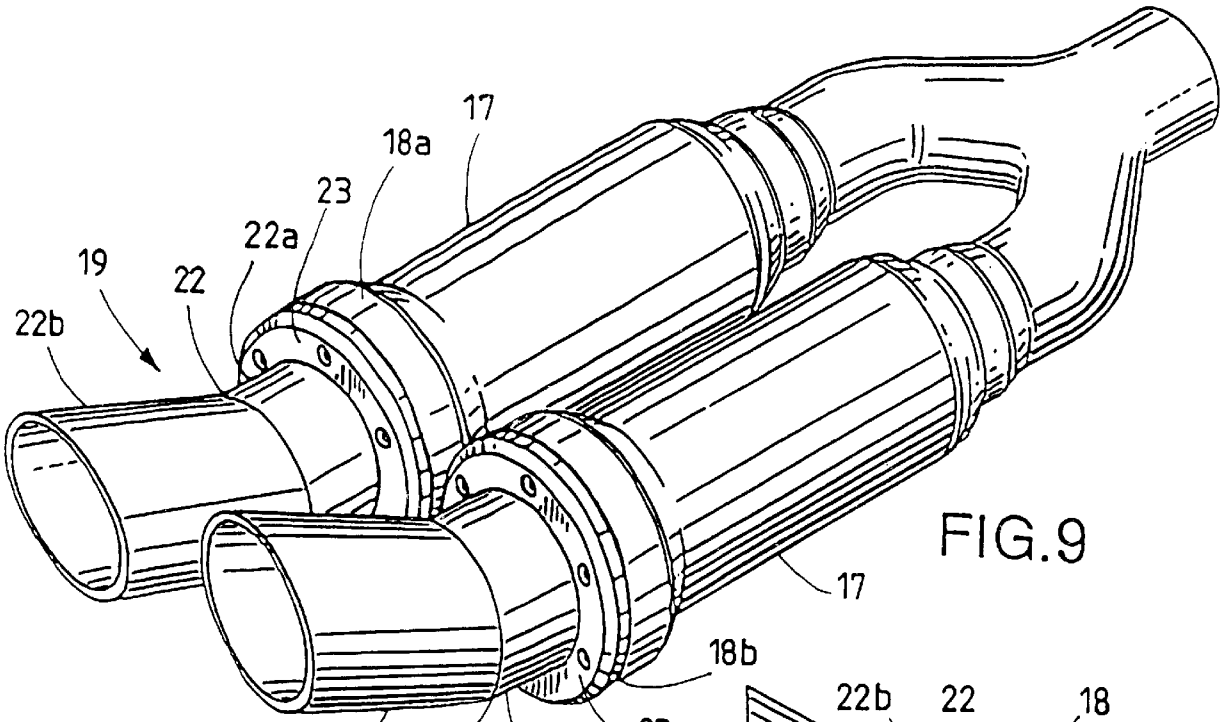
FIG. 9 is a plan view of a third embodiment of a muffler according to the present invention; and, FIG. 10 is a side view of the embodiment of FIG. 9.
Figure 10:
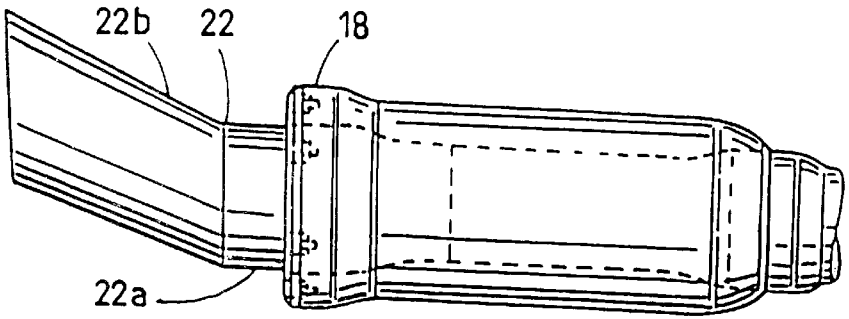

FIGS. 9–10 illustrate an alternate embodiment of the invention in which tips 19 and 20 of FIGS. 7–8 are replaced by two identical tips 19, wherein each tip 19 is detachably connected to a two-casing muffler. In this embodiment, as in the embodiment of FIGS. 7–8, the casing 17 has an outlet end 18 having two ports 18*a* and 18*b* and two groups of threaded holes, wherein each group is distributed around one of the ports 18*a* and 18*b,* respectively. Each of the tips 19 is detachably fastened to the casing 17, in the manner described with reference to FIGS. 1–4. In particular, each tip 19 has a tubular member 22 and annular flange 23, wherein flanges 23 each have holes with a first, narrow portion and a second, wider portion, wherein both portions are cylindrical. Tubular members 22 each comprise two cylindrical portions 22*a* and 22*b* of varying lengths, wherein the portion 22*a* is coaxial to the casing 17 and the portion 22*b* is undetachably connected at an angle to the portion 22*a.* As illustrated in FIGS. 9–10, screws 5 are removably screwed into the holes of ports 18*a* and 18*b,* respectively, of the outlet end 18 and a section of the screws 5 is received in the wider portion of each of the flanges 23 such that the outlet tips 19 can each be fastened to the casing 17. It is understood that the embodiment of FIGS. 9–10 may be modified such that the two identical tips 19 could be replaced by other identical tips, such as tips 20.

The mufflers may be modified in other ways. The nuts 9 welded to the end wall of the outlet end may, for example, be replaced by threaded bolts which are welded to said end wall and project into and/or through the holes of the flange. The screws may then be replaced by nuts which can be screwed onto the bolts and arranged in the second, wider portions of the holes of the attributed flange. Moreover, the holes of the flanges might be replaced by slot-shaped incisions which open into the circumferential surface of the flange and which each could have a first, narrower portion and a second, wider portion corresponding to the first, narrower portion and second, wider portion of a hole of the flange. The end walls of the casing may have a non-circular contour which is, for example, more or less oval and/or "flattened" and has, in the latter case two edge sections which are substantially straight and parallel to one another. The outlet port and the flange of the outlet tip may be eccentric with respect to the axis defined by the casing. Moreover, the end walls need not be completely flat and may be partly conical and/or partly curved in an axial section. However, the end wall of the outlet end should then preferably still have an annular, flat section to which the nuts or possibly bolts are welded such that axes defined by each of the nuts or bolts are parallel to one another and to the axis of the casing.

Though the present invention was shown and described with reference to the specific embodiments of the invention, various modification thereof will be apparent to those skilled in the art and, therefore, it is not intended that the present invention be limited to the disclosed embodiments and/or details thereof, and departure can be made therefrom within the spirit and scope of the appended claims.

What is claimed is:

1. A muffler for an exhaust of a motor vehicle, comprising:

a casing including an inlet end, a first end wall, a tubular wall, and an outlet end comprising a second end wall and threaded holes, wherein the tubular wall connects the first end wall to the second end wall;

an outlet tip having a tubular member and an annular flange fixedly connectable with the tubular member, the flange having a plurality of holes; and a plurality of screws cooperating with the threaded holes for securing the outlet tip to the casing, wherein the holes of the flange each have a first cylindrical portion and a second wider portion, and wherein the screws each have a head at least partially lodged within the second wider portion of the holes of the flange.

2. The muffler of claim 1, wherein the threaded holes include a plurality of separate nuts welded to the second end wall.

3. The muffler of claim 2, wherein the second end wall includes an outlet port and wherein the plurality of nuts are equally distributed around the outlet port.

4. The muffler of claim 1, wherein the casing bounds an interior space and comprises a gasket located between the outlet tip and the outlet end for limiting the interior space.

5. The muffler of claim 1, wherein the heads of the screws each have a multiple cornered hole.

6. The muffler of claim 1, wherein the screws are button head screws.

7. The muffler of claim 1, wherein the holes of the flange are equally distributed on a circle coaxial to an outlet port of the second end wall and coaxial to the tubular member of the tip.

8. The muffler of claim 1, wherein the outlet end of the casing has two outlet ports and two groups of the threaded holes, wherein each group is distributed around one of the outlet ports, and wherein two tips are detachably fastened to the casing, each of the tips being fastened to one of the outlet ports.

9. An exhaust comprising a muffler as claimed in claim 1, wherein the casing has an inlet end opposite said outlet end and connected to at least one of a pipe, another muffler, a catalytic converter and an exhaust manifold.

10. A tip set for use with a muffler for an exhaust of a motor vehicle, wherein the muffler comprises a casing including an inlet end, a first end wall, a tubular wall, and an outlet end comprising a second end wall and threaded holes, wherein the tubular wall connects the first end wall to the second end wall, the tip set comprising:

at least two outlet tips, wherein each outlet tip has a tubular member and an annular flange fixedly connectable with the tubular member, the flange having a plurality of holes; and a plurality of screws cooperating with the threaded holes such that the outlet tips are alternately fastenable to the muffler casing, wherein the holes of the flange each have a first cylindrical portion and a second wider portion, wherein the screws each have a head at least partially lodged within the second wider portion of the holes of the flange and wherein the at least two outlet tips have at least one of different shapes and different dimensions.

11. The set of claim 10, wherein said at least two outlet tips include outlet tips with tubular members having different diameters.

12. The set of claim 10, wherein the casing has two outlet ports and two groups of threaded holes each distributed around one of the outlet ports and wherein said outlet tips include at least two pairs of outlet tips alternately fastenable to the casing and wherein the two pairs have tubular members with at least one of different shapes and different dimensions.

13. A tip set for use with a muffler for an exhaust of a motor vehicle, wherein the muffler comprises a casing including an inlet end, a first end wall, a tubular wall, and an outlet end comprising a second end wall and threaded bolts fastened to the casing, wherein the tubular wall connects the first end wall to the second end wall, the tip set comprising:

at least two outlet tips, wherein each outlet tip has a tubular member and an annular flange fixedly connectable with the tubular member, the flange having a plurality of holes; and a plurality of nuts cooperating with the threaded bolts such that the outlet tips are alternately fastenable to the muffler casing, wherein the holes of the flange each have a first cylindrical portion and a second wider portion, wherein the nuts each are at least partially lodged within the second wider portion of the holes of the flange and wherein the at least two outlet tips have at least one of different shapes and different dimensions.

* * * * *